US011432992B2

(12) United States Patent
Tang

(10) Patent No.: US 11,432,992 B2
(45) Date of Patent: Sep. 6, 2022

(54) VIBRATING EGG FOR SEXUAL STIMULATION

(71) Applicant: Yiqun Tang, Ji'an (CN)

(72) Inventor: Yiqun Tang, Ji'an (CN)

( * ) Notice: Subject to any disclaimer, the term of this patent is extended or adjusted under 35 U.S.C. 154(b) by 0 days.

(21) Appl. No.: 17/102,462

(22) Filed: Nov. 24, 2020

(65) Prior Publication Data

US 2021/0077341 A1 Mar. 18, 2021

(51) Int. Cl.
*A61H 19/00* (2006.01)
*A61H 23/02* (2006.01)

(52) U.S. Cl.
CPC ..... *A61H 19/40* (2013.01); *A61H 19/34* (2013.01); *A61H 23/02* (2013.01); *A61H 2201/1207* (2013.01); *A61H 2201/5023* (2013.01); *A61H 2201/5097* (2013.01)

(58) Field of Classification Search
CPC ..... A61H 19/34; A61H 19/30; A61H 19/32; A61H 19/40; A61H 19/44; A61H 19/50; A61H 2201/10; A61H 2201/1207; A61H 2201/5023; A61H 2201/5097; A61H 2205/087; A61H 23/02; A61H 23/0263
See application file for complete search history.

(56) References Cited

U.S. PATENT DOCUMENTS

| | | | | |
|---|---|---|---|---|
| 10,940,078 | B1 * | 3/2021 | Lee | A61H 19/34 |
| 2018/0289585 | A1 * | 10/2018 | Murison | A61H 19/44 |
| 2020/0038285 | A1 * | 2/2020 | Bauer | H01M 10/4221 |

* cited by examiner

*Primary Examiner* — Christine H Matthews

(57) ABSTRACT

The present invention relates to the field of sexy toys, in particular to a sexy vibrating egg with a vagina-shrinking function. According to the sexy vibrating egg with the vagina-shrinking function of the present invention, by providing the electrode modules, the vagina or clitoris can be better stimulated, and in combination with the vibration caused by the eccentric block driven by the motor, a greater stimulation required by women can be met, thus better improving the effect of flirting between partners. In addition, the sexy vibrating egg can be used for vagina-shrinking training when it is turned off or turned on.

6 Claims, 4 Drawing Sheets

VIBRATING EGG FOR SEXUAL STIMULATION

TECHNICAL FIELD

The present invention relates to the field of sex toys, in particular to a sexy vibrating egg with a vagina-shrinking function.

BACKGROUND

A sexy vibrating egg, as a little sexy toy used by couples to adjust sexual life, has the functions of injecting fresh elements into the life and enhancing the relationship between the couples, and thus becomes an indispensable auxiliary tool in married life.

A vagina-shrinking ball, also referred to as a vaginal dumbbell or vaginal yoga ball, is a kind of exercise tool that is put in the vagina of women to enhance the sensitivity and flexibility of the inner wall of the vagina and the female sphincter and pelvic floor muscles, and make them instantly sensitive, and thus the tension and relaxation of the muscles of the vaginal wall accelerate the pleasure of orgasm. At present, many women, especially postpartum women, are experiencing the trouble of vaginal slack, while the vagina-shrinking ball can solve the problem of female vaginal slack through physical exercise.

In the prior art, most of the vagina-shrinking balls are marble-type vagina-shrinking balls. Although such vagina-shrinking balls have a good curative effect on solving the problem of female vaginal slack, there are also many defects in the process of use. For example, a marble of the marble-type vagina-shrinking ball has a hard texture, which will make women feel uncomfortable. The vibration of the marble-style vagina-shrinking ball is often irregular and not adjustable in frequency and intensity.

Therefore, the existing sexy vibrating egg has no vagina-shrinking function, and the vibration frequency and intensity thereof can no longer satisfy people's more passionate pursuits.

SUMMARY

In order to solve the above-mentioned problems, the present invention provides a sexy vibrating egg with a vagina-shrinking function, which can not only achieve an adjustable vibration frequency, but also has an effect of current pulse, thereby satisfying people's more passionate pursuits.

To fulfill the above objective, the present invention adopts the following technical solution: a sexy vibrating egg with a vagina-shrinking function includes a waterproof silicone housing and a vibrating assembly arranged inside the housing, wherein a strip body extends from one end of the housing; the surface of the housing is provided with control keys and a magnetic charging port; the vibrating assembly includes a casing, and a battery, a motor, an eccentric block and a circuit board arranged in the casing; the circuit board is electrically connected to the battery and the motor, respectively; the eccentric block is fixed with a drive shaft of the motor and arranged at one end away from the strip body; positive and negative electrode modules are respectively arranged on two sides of the casing, and extend to the surface of the housing; the control keys are electrically connected to the circuit board; the magnetic charging port is electrically connected to the battery through a charging module; and the positive and negative electrode modules are electrically connected to the battery and the circuit board respectively.

Further, the casing includes an upper casing and a lower casing; corresponding slots are respectively reserved in both sides of each of the upper casing and the lower casing; the electrode modules are respectively clamped and fixed to the slots; the upper end of the upper casing is provided with a key port for adjusting the control keys; the control keys on the circuit board extend to the key port; the lower end of the lower casing is provided with a through hole for the charging module to penetrate; and the charging module penetrates the through hole and extends to the surface of the housing.

The casing is elliptical and is entirely wrapped by the housing; the charging module includes a waterproof clamping board; the housing is provided with holes in both sides and an opening in the lower end, wherein the electrode modules are clamped and fixed to the holes to form a waterproof seal, and the waterproof clamping board is clamped and fixed to the opening of the housing to form a waterproof seal.

Further, each of the electrode modules includes a positive electrode slice and a negative electrode slice which are respectively arranged on the surface of the housing.

Further, the end of the strip body is in an egg-like shape which is inclined toward the upper end.

Further, an on-off breathing light is arranged inside the egg-like shape, and electrically connected to the circuit board through a wire.

Further, the motor is a frequency-adjustable motor.

Further, the control keys include an on/off key and a frequency modulation key.

Further, the sexy vibrating egg further includes a remote controller, wherein the remote controller and the circuit board are respectively provided with a corresponding wireless communication module, and the remote controller performs remote control through the wireless communication module.

The wireless communication module is a Bluetooth™ module or a WiFi module.

The present invention has the following beneficial effects: the sexy vibrating egg with the vagina-shrinking function is smooth in appearance, easy to clean, and convenient to store and carry. With the provision of the electrode modules, the vagina or clitoris can be better stimulated, and in combination with the vibration caused by the eccentric block driven by the motor, a greater stimulation required by women can be met, thus better improving the effect of flirting between partners. In addition, the sexy vibrating egg can be used for vagina-shrinking training when it is turned off or turned on. The simultaneous action of current and vibration can better stimulate the vagina, thereby stimulating the automatic shrinkage of the muscles in the vagina, realizing the strengthening exercise of the pelvic floor muscles, and thus solving the problem of vaginal slack.

Figure 1:
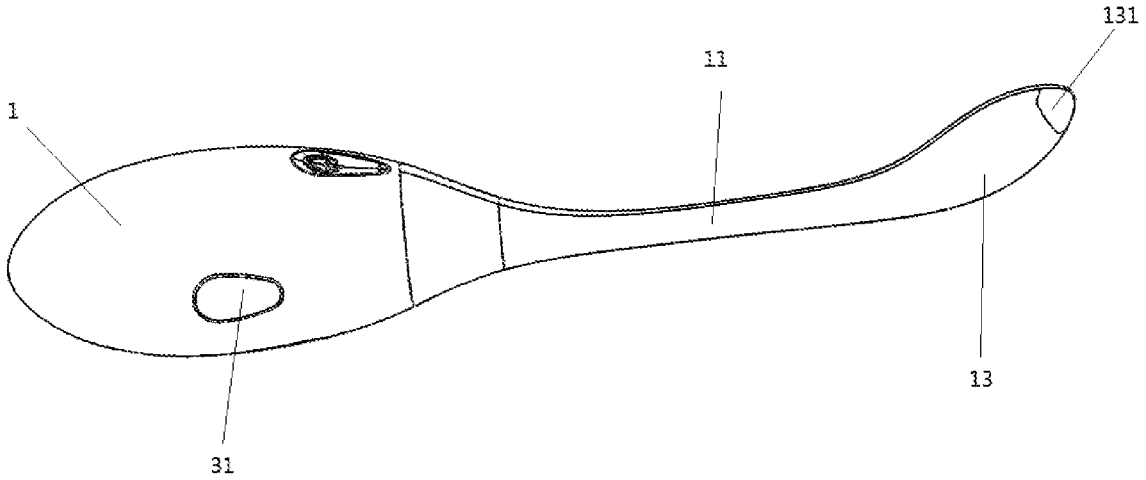
FIG. 1 is a schematic perspective view of the present embodiment.

Reference numerals: 1—housing; 11—strip body; 12—magnetic charging port; 13—egg-like shape; 131—breathing light; 2—vibrating assembly; 21—casing; 211—upper casing; 212—lower casing; 213—slot; 22—battery; 23—motor; 24—eccentric block; 25—circuit board; 251—control key; 26—charging module; 261—waterproof clamping board; 3—electrode module; 31—electrode slice; 211*a*—upper end of the upper casing; 211*b*—key port; 212*a*—lower end of the lower casing; 212*b*—through hole; 1*a*—holes in both sides of the housing; 1*b*—opening.

DETAILED DESCRIPTION

The present invention will be further described below in detail through specific embodiments in conjunction with the accompanying drawings. The present application can be implemented in many different forms but not limited to the implementation described in the present embodiment. The following specific implementation is provided for the purpose of facilitating a clearer and thorough understanding of the disclosure of the present application, wherein the terms indicating directions such as "up", "down", "left", and "right" are only directed to the positions of the structures shown in the corresponding drawings.

Figure 2:
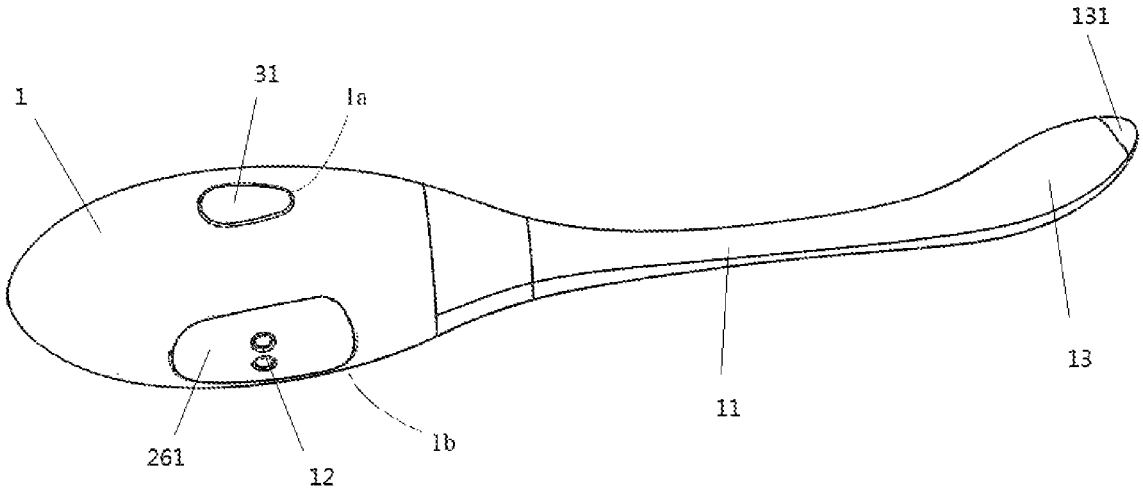
FIG. 2 is another schematic perspective view of the present embodiment.
Figure 3:
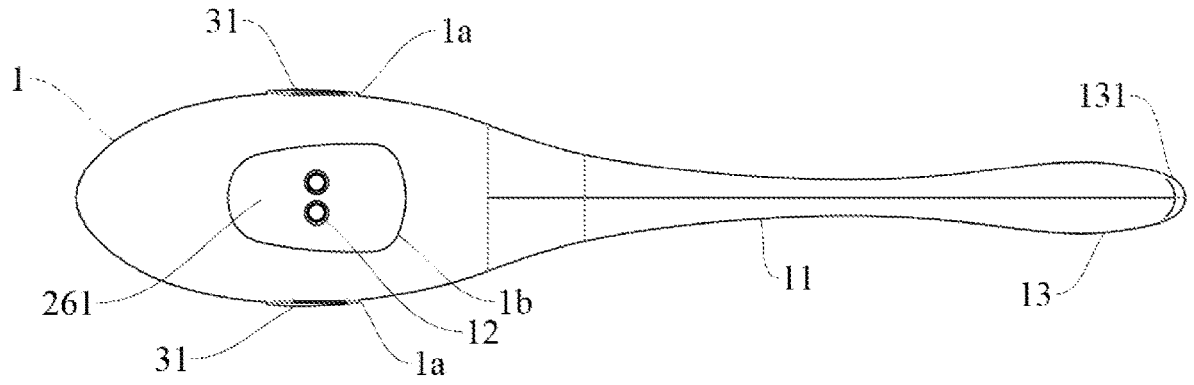
FIG. 3 is one more schematic perspective view of the present embodiment.
Figure 4:
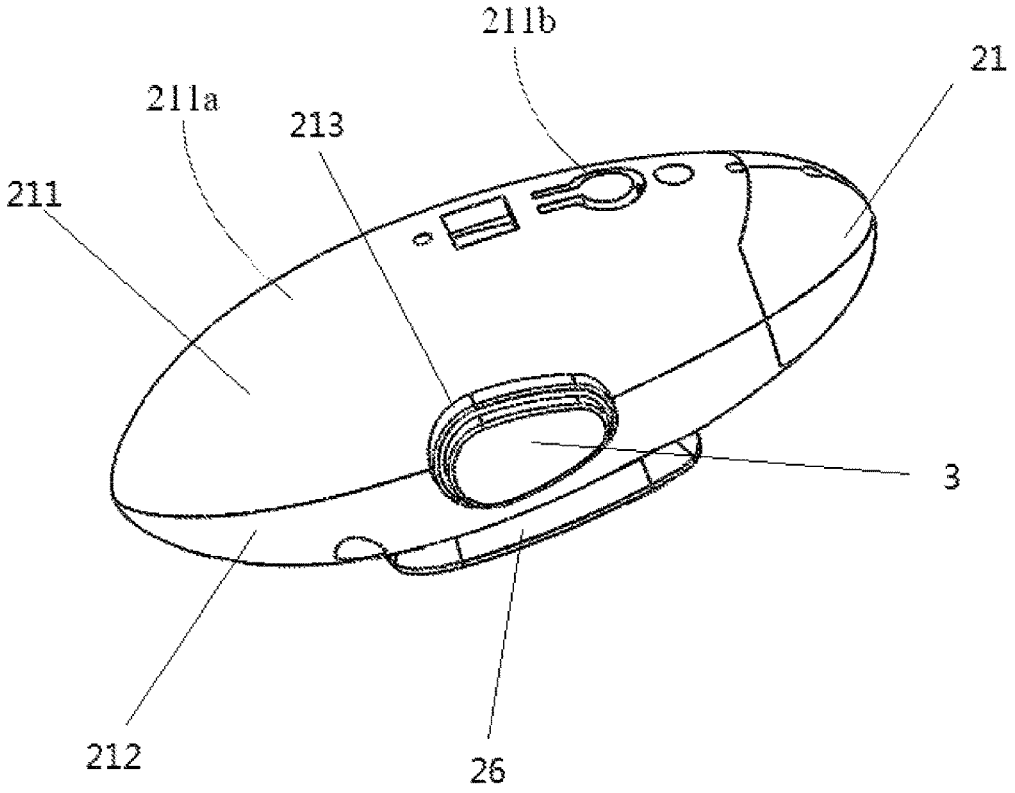
FIG. 4 is a schematic structural diagram of a vibrating assembly in the present embodiment.
Figure 5:
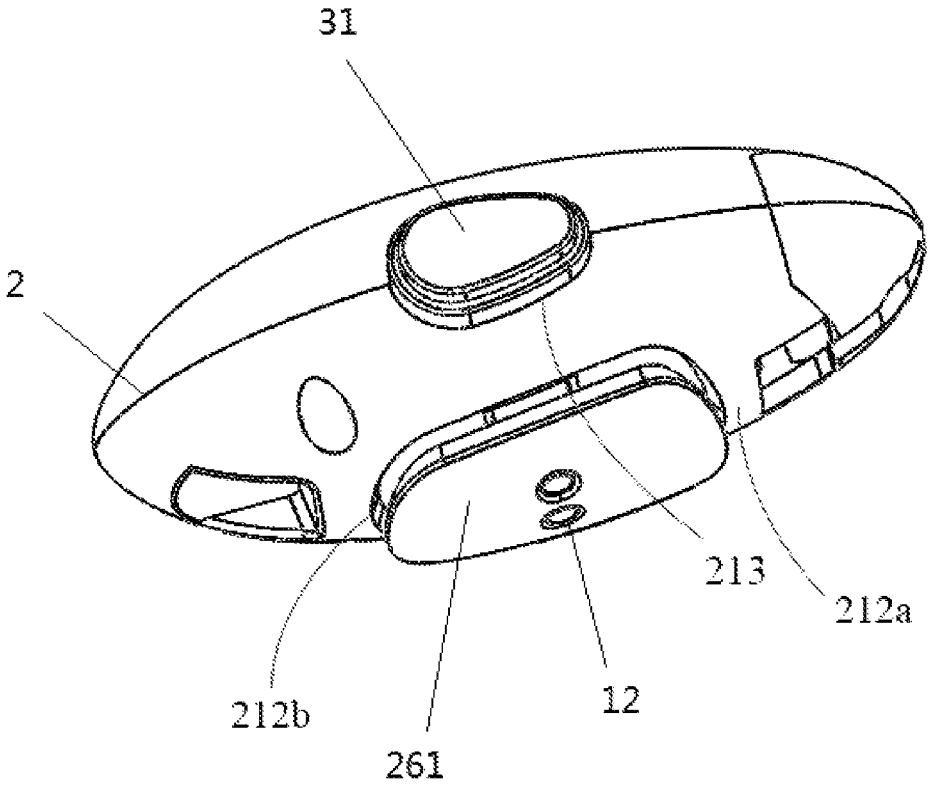
FIG. 5 is another schematic structural diagram of the vibrating assembly in the present embodiment.
Figure 6:
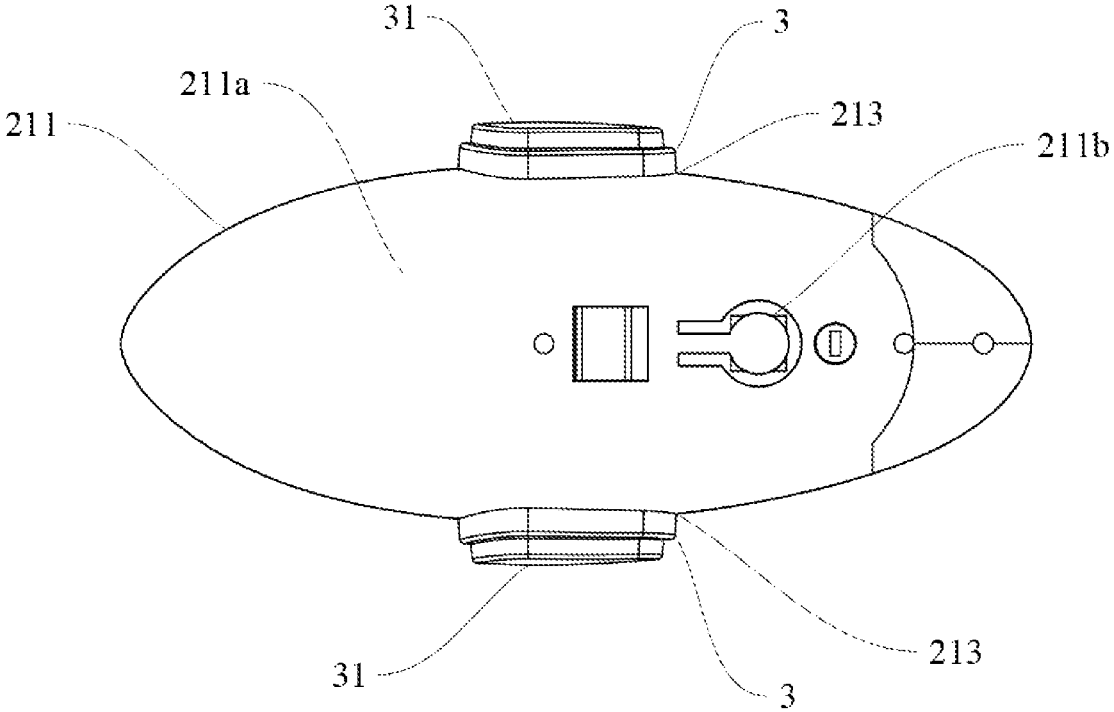
FIG. 6 is one more schematic structural diagram of the vibrating assembly in the present embodiment.
Figure 7:
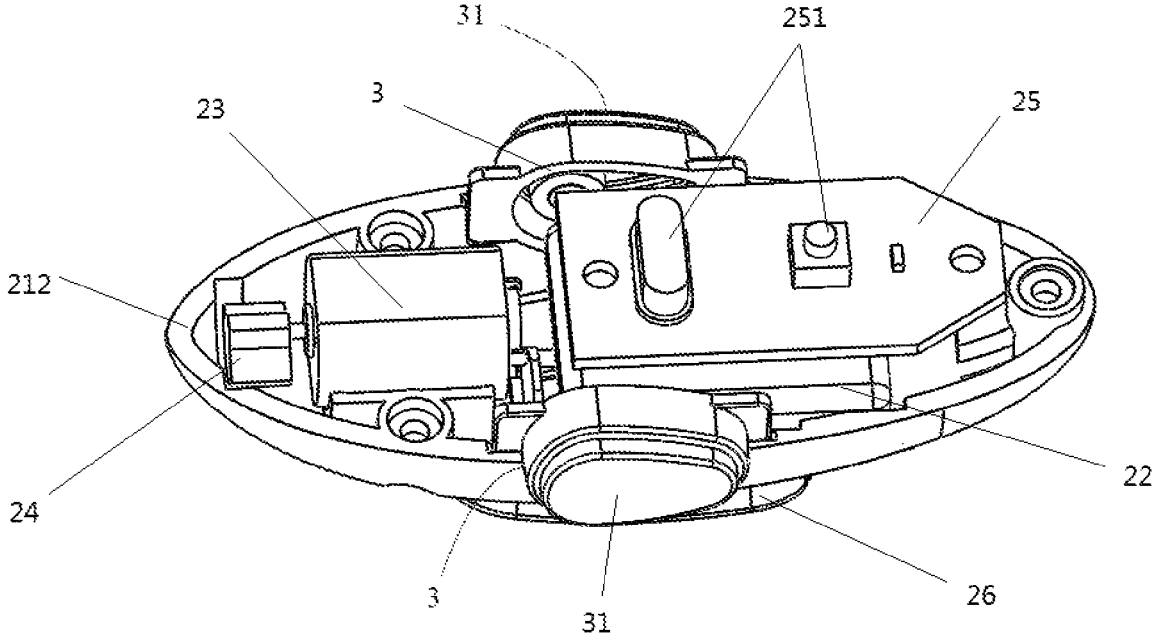
FIG. 7 is a schematic structural diagram of the inside of the vibrating assembly in the present embodiment.
Figure 8:
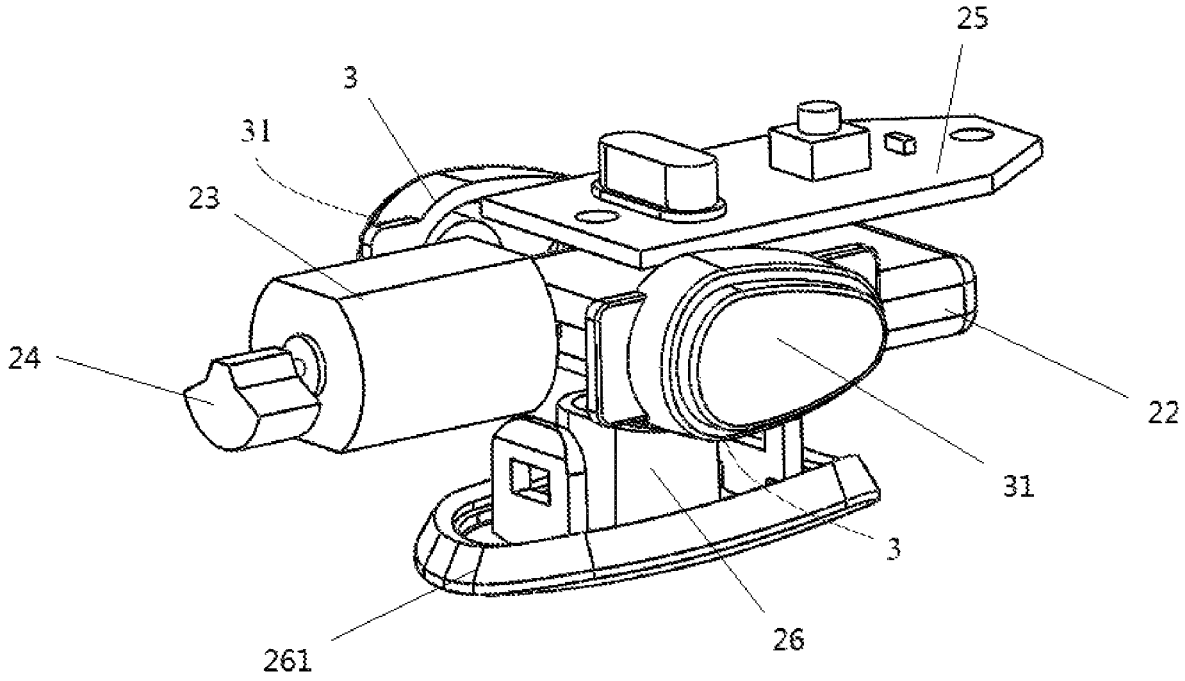
FIG. 8 is another schematic structural diagram of the inside of the vibrating assembly in the present embodiment.

As shown in FIGS. 1-8, a sexy vibrating egg with a vagina-shrinking function of the present invention includes a waterproof silicone housing 1 and a vibrating assembly 2 arranged inside the housing 1. A strip body 11 extends from one end of the housing 1. The surface of the housing 1 is provided with control keys and a magnetic charging port 12. The vibrating assembly 2 includes a casing 21, and a battery 22, a motor 23, an eccentric block 24 and a circuit board 25 arranged in the casing 21. The circuit board 25 is electrically connected to the battery 22 and the motor 23, respectively. The eccentric block 24 is fixed with a drive shaft of the motor 23, and arranged at one end away from the strip body 11. Positive and negative electrode modules 3 are respectively arranged on two sides of the casing 21, and extend to the surface of the housing 1. The control keys 251 are electrically connected to the circuit board 25. The magnetic charging port 12 is electrically connected to the battery 22 through a charging module 26. The positive and negative electrode modules 3 are electrically connected to the battery 22 and the circuit board 25 respectively.

In the present embodiment, the casing 21 includes an upper casing 211 and a lower casing 212. Corresponding slots 213 are respectively reserved in both sides of each of the upper casing 211 and the lower casing 212. The electrode modules 3 are respectively clamped and fixed to the slots 213. The upper end 211*a* of the upper casing 211 is provided with a key port 211*b* for adjusting the control keys. The control keys 251 on the circuit board 25 extend to the key port 211*b*. The lower end 212*a* of the lower casing 212 is provided with a through hole 212*b* for the charging module 26 to penetrate. The charging module 26 penetrates the through hole 212*b* and extends to the surface of the housing 1. The casing 21 is elliptical and entirely wrapped by the housing 1. The charging module 26 includes a waterproof clamping hoard 261. The housing 1 is provided with holes 1*a* in both sides and an opening 1*b* in a lower end. The electrode modules 3 are clamped and fixed to the holes to form a waterproof seal, and the waterproof clamping board 261 is clamped and fixed to the opening 1*b* of the housing to form a waterproof seal. The silicone housing 1 can be elastically sleeved on the electrode modules and the waterproof clamping board 261 when being clamped and fixed with the electrode modules 3 and the waterproof clamping board 261 since it is environmentally-friendly, soft and comfortable and has good elasticity, thereby achieving a waterproofing effect.

In the present embodiment, each electrode module 3 includes a positive electrode slice and a negative electrode slice. The electrode slices 31 are respectively arranged on the surface of the housing 1, and can contact the human body and generate an electric current, and especially can better stimulate the wet vagina. In the present embodiment, a direct current of 5-10 mA is used, which can ensure the safety of the human body in the case of current stimulation, and the safe current that the human body can withstand is 50 mA.

In the present embodiment, the end of the strip body 11 is an egg-like shape 13 which is arranged obliquely toward the upper end. The entire housing 1 is made of a food-grade silicone material with a tail, which is very suitable for users to use. In addition, an on-off breathing light 131 is provided inside the egg-like shape 13, and is electrically connected to the circuit board 25 through a wire. When the device is turned on, the breathing light 131 will remind the user of a state of use. In the present embodiment, the motor 23 is a frequency-adjustable motor. The control keys 251 include an on/off key, and a frequency modulation key which enables change of the vibration frequency.

Furthermore, the sexy vibrating egg further includes a remote controller 4. The remote controller 4 and the circuit board 25 are respectively provided with a corresponding wireless communication module through which the remote controller 4 performs remote control. The wireless communication module is a 433 international universal frequency or Bluetooth™ module or a WiFi module. The user may also remotely control the on/off of the vibrating egg and the vibration frequency of the motor 23 through the remote controller 4, which is not only convenient to use, but also brings a better user experience.

In the present embodiment, when the sexy vibrating egg is used, the on/off key is pressed and held for 1.5 s first to turn on the vibrating egg, and the frequency modulation key is pressed fast to start the motor 23. When the frequency modulation key is pressed again, the vibration frequency of the motor 23 will be gradually increased until a fifth-level vibration frequency is reached. A first-level vibration frequency will be restored if the frequency modulation key is pressed again, and so on.

When performing the vagina-shrinking training, the user first puts the elliptical housing 1 into the vagina, exposes the strip body with the egg-like shape 13 outside the vagina, and then controls the motor 23 or the electrode slices 31 to be turned on or off through the remote controller 4. The user may also consciously cooperate and control the vaginal muscle contraction, so as to exercise and strengthen the muscle.

It should be noted that unless otherwise clearly prescribed and defined, the terms "connected", "fixed", and "arranged" should be understood in a broad sense. For those of ordinary skill in the art, the specific meaning of the above terms in the present invention can be understood in specific situations.

The above embodiments are only a description of the preferred embodiments of the present invention, and do not limit the scope of the present invention. It should be noted that for those of ordinary skill in the art, various improvements and modifications made for the technical solution of the present invention without departing from the design spirit of the present invention should fall within the protection scope defined by the claims of the present invention.

What is claimed is:

1. A vibrating egg for sexual stimulation, comprising: a waterproof silicone housing and a vibrating assembly arranged inside the housing, wherein a strip body extends from one end of the housing;

wherein a surface of the housing is provided with control keys and a magnetic charging port;

wherein the vibrating assembly comprises a casing, and a battery, a motor, an eccentric block and a circuit board arranged in the casing; wherein the circuit board is electrically connected to the battery and the motor respectively; wherein the eccentric block is fixed with a drive shaft of the motor, and arranged at an other end of the housing away from the strip body;

wherein the vibrating egg further comprises positive and negative electrode modules respectively arranged on two sides of the casing, and extending to the surface of the housing;

wherein the control keys are electrically connected to the circuit board; wherein the magnetic charging port is electrically connected to the battery through a charging module;

wherein the positive and negative electrode modules are electrically connected to the battery and the circuit board respectively;

wherein the casing comprises an upper casing and a lower casing; corresponding slots are respectively reserved in two sides of each of the upper casing and the lower casing;

the electrode modules are respectively clamped and fixed to the slots; an upper end of the upper casing is provided with a key port for adjusting the control keys; the control keys extend to the key port; a lower end of the lower casing is provided with a through hole; and the charging module penetrates the through hole and extends to the surface of the housing.

2. The vibrating egg for sexual stimulation according to claim 1, wherein the casing is elliptical and is entirely wrapped by the housing; the charging module comprises a waterproof clamping board; the housing is provided with holes in two sides and an opening in a lower end, wherein the electrode modules are clamped and fixed to the holes to form a waterproof seal, and the waterproof clamping board is clamped and fixed to the opening of the housing to form a waterproof seal.

3. The vibrating egg for sexual stimulation according to claim 2, wherein each of the electrode modules comprises a positive electrode slice and a negative electrode slice which are respectively arranged on the surface of the housing.

4. The vibrating egg for sexual stimulation according to claim 1, wherein an end of the strip body is inclined toward the upper end of the upper casing.

5. The vibrating egg for sexual stimulation according to claim 1, wherein the motor is a frequency-adjustable motor.

6. The vibrating egg for sexual stimulation according to claim 1, wherein the control keys include an on/off key and a frequency modulation key.

* * * * *